US005346097A

United States Patent [19]

Melland et al.

[11] Patent Number: 5,346,097

[45] Date of Patent: Sep. 13, 1994

[54] DISPENSING CONTAINER

[76] Inventors: Tristan G. Melland; Clive H. Gay, both of 8 Printing House Yard, Hackney Rd., Shoreditch, London, England E2 7PR

[21] Appl. No.: 844,605

[22] PCT Filed: Oct. 5, 1990

[86] PCT No.: PCT/GB90/01537

§ 371 Date: Jun. 2, 1992

§ 102(e) Date: Jun. 2, 1992

[87] PCT Pub. No.: WO91/04923

PCT Pub. Date: Apr. 18, 1991

[30] Foreign Application Priority Data

Oct. 6, 1989 [GB] United Kingdom ..... 8922542

[51] Int. Cl.[5] ..... B67D 5/60

[52] U.S. Cl. ..... 222/132; 222/484; 222/566; 222/546; 222/562

[58] Field of Search ..... 222/129, 132, 94, 478, 222/484, 485, 482, 566, 546, 562, 142.5, 142.1; 220/4.13; 215/6

[56] References Cited

U.S. PATENT DOCUMENTS

| | | | |
|---|---|---|---|
| 825,680 | 7/1906 | Raymond | 222/129 |
| 1,646,322 | 10/1927 | Smith | 222/142.1 |
| 2,655,282 | 10/1953 | Dunbar | 215/6 |
| 2,661,871 | 12/1953 | Huenergardt . | |
| 2,665,816 | 1/1954 | Anft . | |
| 3,059,816 | 10/1962 | Goldstein | 222/484 |
| 3,643,829 | 2/1972 | Lachner . | |
| 3,655,102 | 4/1972 | Moran | 222/484 |
| 3,729,553 | 4/1973 | Gold et al. | 222/94 |
| 4,148,417 | 4/1979 | Simmons | 222/94 |

FOREIGN PATENT DOCUMENTS

| | | | |
|---|---|---|---|
| 255871 | 7/1911 | Fed. Rep. of Germany . | |
| 827537 | 1/1952 | Fed. Rep. of Germany . | |
| 2017292 | 10/1971 | Fed. Rep. of Germany | 222/94 |
| 3514134 | 10/1986 | Fed. Rep. of Germany . | |
| 1180427 | 2/1970 | United Kingdom . | |
| 2135290 | 8/1984 | United Kingdom . | |

*Primary Examiner*—H. Grant Skaggs
*Attorney, Agent, or Firm*—Cushman, Darby & Cushman

[57] ABSTRACT

The dispensing container has a bottle with at least two compartments for accommodating different fluent components. The compartments are so designed that they dispense their contents at equal flow rates when the bottle it tilted. In addition, security is provided against cross-contamination of the contents of the different compartments when, after a dispensing operation, the bottle is righted again. The bottle is provided with a cap that seals off the outlets from the compartments simultaneously when fitted to the bottle. The cap can be a separate component or it can be provided as a flip-top cap. The bottle is made entirely of plastics material and directional pouring spouts can be provided to ensure that the contents of the compartments leave in well-defined streams during a dispensing operation.

14 Claims, 4 Drawing Sheets

DISPENSING CONTAINER

This invention relates to a dispensing container having multiple compartments.

There are numerous applications in which a multi-compartment container would be useful to dispense different components of a mixed product simultaneously. For instance, German patent document DE 3220693A discloses a two-compartment bottle which is designed to dispense different liquid components of a mixed drink in a single pour.

In some cases, it would be desirable with such a multi-compartment container to prevent any mixing of the components stored in the different compartments until such time as they are actually dispensed into a receiving vessel. This would be particularly so where the components are intended to react with one another, physically or chemically, to produce a required mixed product. In the case of the German specification referred to above, the pouring necks of the two compartments are separated from one another solely by a common dividing wall and there is a strong possibility of one component contaminating the other at the neck during pouring and even thereafter as the bottle is righted again and drops of liquid at the mouth flow back, possibly into the wrong compartment.

The present invention provides a dispensing container which includes:

a) a moulded bottle formed in one piece and comprising at least two distinct compartments for accommodating different fluent materials, each compartment having an outlet at an operatively upper end thereof, the compartments having equal total volumes and also having equal cross-sectional areas at each level of the bottle;

b) a pouring spout communicating with each of the compartment outlets, the pouring spouts being spaced apart from one another with the centres of the pouring spouts lying on an imaginary straight line, each pouring spout being defined by a continuous circumscribing wall which is spaced apart from the circumscribing wall of any other pouring spout not shared by any other pouring spout; and c) a single cap dimensioned to fit onto the operatively upper end of the bottle and having sealing means for sealing all the pouring spouts simultaneously when so fitted; and the design of the spout and bottle being such that when the cap is removed and the bottle is tilted away from an upright orientation with the imaginary straight line remaining horizontal, the contents of the compartments are dispensed simultaneously at equal flow rates and in distinct streams, from the compartments, without cross-contamination between adjacent streams, and when the bottle is thereafter returned to an upright orientation, fluent material originating from one compartments is prevented from flowing back into any other compartment and cross-contamination of the compartments is avoided characterised in that the container further includes:

d) an air vent associated with each compartment outlet which is also sealed by the cap when the cap is fitted onto the operatively upper end of the bottle; and furthermore wherein the provision of an air vent for each compartment outlet allowing air to enter each compartment as the contents of the compartments are dispensed, thereby ensuring that the contents of the compartments are dispensed smoothly in their distinct streams.

Preferably, the pouring spouts are directional pouring spouts. The pouring spouts may be provided by a one-piece spout member fitted to the outlets of the compartments. Alternatively, the pouring spouts are provided by a member fitted to the operatively upper end of the bottle and the cap is a flip-top cap formed in one piece with the member and joined to the member at a live hinge. In yet another alternative, the pouring spouts are formed in one piece with the bottle.

The bottle in one embodiment has three compartments each for accommodating a different fluent material. In this case, the bottle may have a central compartment and two outer compartments symmetrically arranged on opposite sides of the central compartment, the central compartment having a generally rectangular cross-sectional shape over at least a part of the height of the bottle and the two outer compartments each having a generally semi-circular cross-sectional shape over the same part of the height of the bottle.

For added security against cross-contamination, each compartment may be defined by its own continuous wall which is not shared by the wall defining any other compartment, the walls of adjacent compartments being connected integrally to one another by means of joining portions. The joining portions of the walls of adjacent compartments can space those walls apart from one another to create externally visible, aesthetically pleasing grooves extending for the height of the bottle.

In one embodiment, the cap and bottle have cooperating clip formations which engage one another in clipping fashion when the cap is correctly fitted over the upper end of the bottle. The bottle may have a continuous external shoulder towards its upper end against which the cap bears when clipped to the bottle. The cap may have internally projecting formations which plug the pouring spouts when the cap is clipped to the bottle. The clipping formations of the cap and the bottle are preferably disengagable from one another to permit removal of the cap from the bottle when an appropriate squeezing action is applied to the cap in a direction transverse to the height of the bottle.

For convenient and accurate dispensing of the contents of the compartments it is preferred that the bottle have an external shape that is chosen to facilitate manual gripping by a user in such manner that tilting of the bottle by the user to dispense therefrom will generally be such as to maintain the imaginary straight line horizontal.

Embodiments of the invention will now be described in more detail, by way of example only, with reference to the accompanying drawings in which.

Referring to FIGS. 1 to 8 of the drawings, there is shown a bottle 10, a spout member 11 and a cap 12. The bottle 10 is made of a thermoplastics material extrusion blow moulded to the illustrated form. The spout member 11 and cap 12 are also made of thermoplastics material, and are in this case injection moulded.

Figure 1:
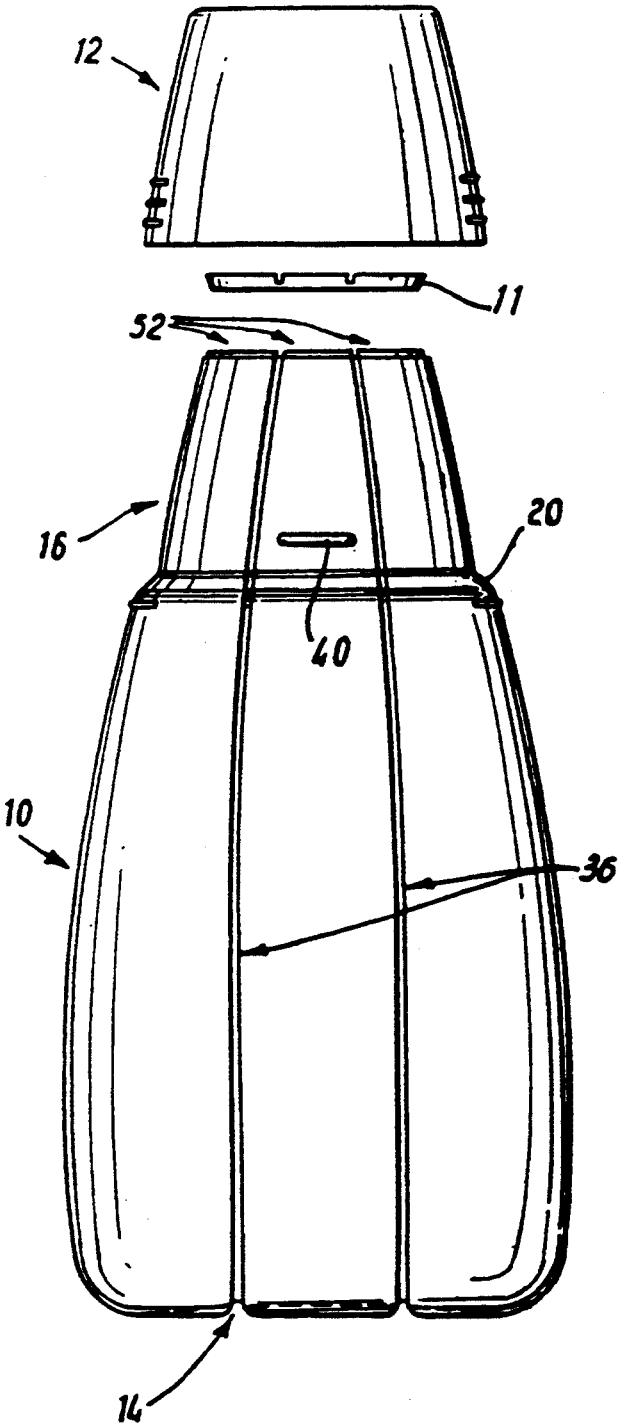
FIG. 1 shows a front, exploded elevation of a bottle, cap and spout according to a first embodiment of the invention.
Figure 2:
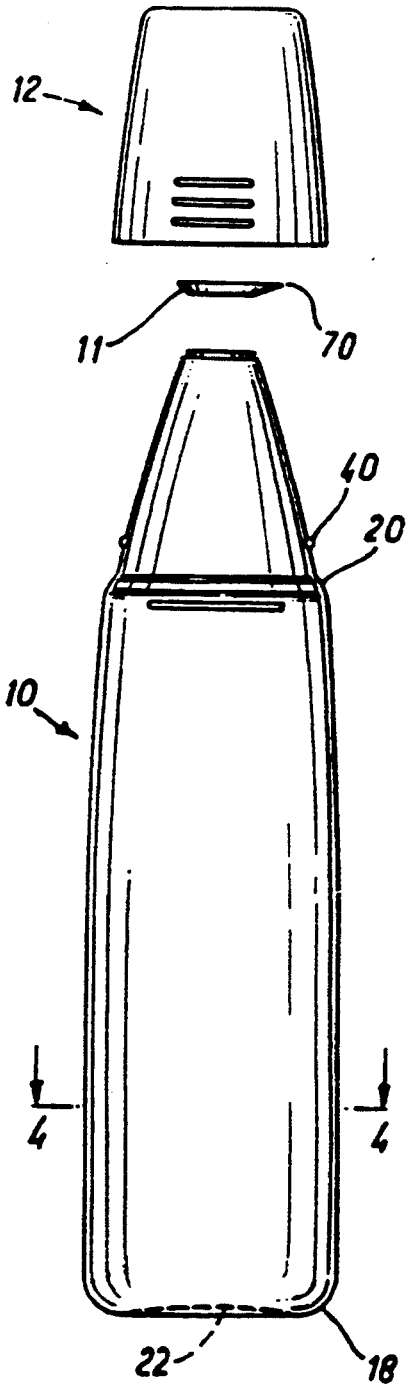
FIG. 2 shows a side, exploded elevation of the bottle, cap and spout of FIG. 1.
Figure 3:
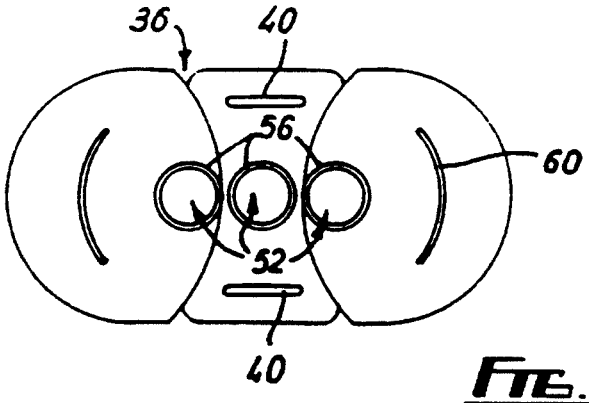
FIG. 3 shows a plan view of the bottle with the spout member omitted.
Figure 4:
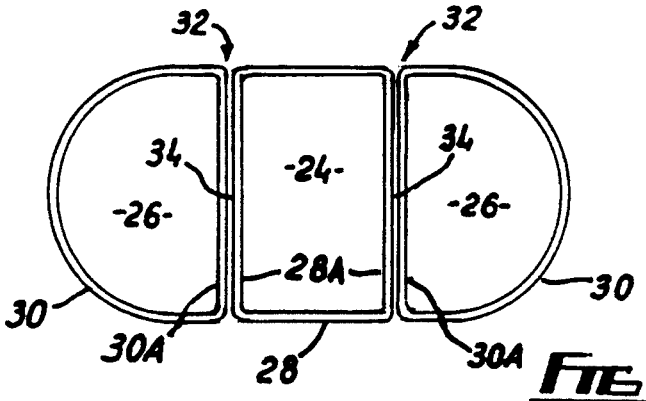
FIG. 4 shows a cross-section at the line 4—4 in FIG. 2.

The bottle 10 has a shape which tapers down substantially in cross-section in a direction from the bottom 14 to the neck region 16 in the view of FIG. 1. As shown in FIG. 2, the bottle also tapers slightly from bottom to top in side view, but not nearly in so pronounced a manner as in the FIG. 1, front view. Rounded corners 18 mark the transition from the side walls to the bottom wall and a shoulder 20 is provided towards the neck region 16. The bottom of the bottle is slightly concave as illustrated at 22 in FIG. 2. The bottle has three separate compartments for accommodating different fluent components, in this case, liquid components which are to be mixed to form an effervescent liquid mouthwash. As will be clear from FIG. 4, the central compartment 24 has a generally rectangular shape while the outer compartments 26 have generally semi-circular shapes. The three compartments in combination give the bottle a generally oval or elliptical cross-sectional shape throughout its height. The compartment cross-sectional shapes change as the bottle tapers upwardly.

Figure 7:
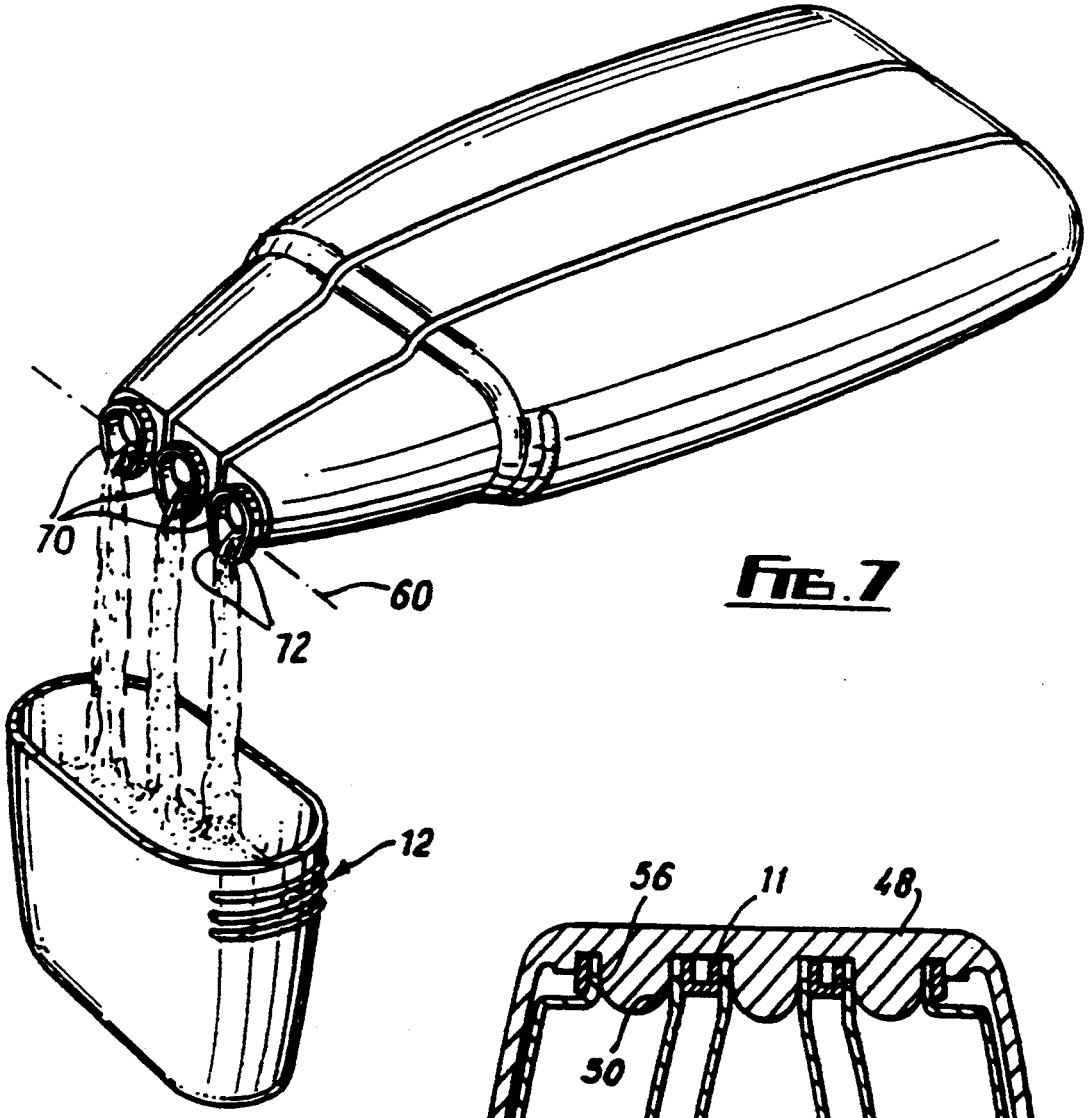
FIG. 7 illustrates the bottle of the first embodiment during pouring.

Each compartment has exactly the same volume and the intention is that, when the bottle is held at the correct, FIG. 7 orientation for pouring, the liquid components are dispersed simultaneously at substantially the same volumetric rate from all three compartments. This ensures that the contents of the three compartments are consumed at the same rate, with the result that no one compartment should empty before the others and that there is no wastage of unconsumed components. Also, after each dispensing operation, each compartment will have substantially the same level as the other compartments.

It will be appreciated that, in order to obtain equal flow rates from all three compartments simultaneously, the cross-sectional areas of all three compartments should be the same at each level in the bottle.

The three components accommodated in the three compartments may be distinguished from one another by having different colours to give an attractive appearance when dispensing takes place.

Each of the three compartments is defined by its own continuous wall, numbered 28 in the case of the central compartment and 30 in the case of the outer compartments. The straight, adjacent portions of the walls 28 and 30, numbered 28A and 30A, are spaced from one another by small gaps 32 and joining portions 34 serve to connect the wall portions 28A and 30A together. In the result the bottle 10 has, in the front elevation of FIG. 1, two deep, aesthetically pleasing grooves 36 running from top to bottom thereof.

To create the grooved appearance of the bottle 10, i.e. to create the gaps 32 between the wall portions 28A and 30A, the blow mould which is used in the blow moulding operation will have slender mould formations on two opposite sides of which the blank is moulded.

Figure 5:
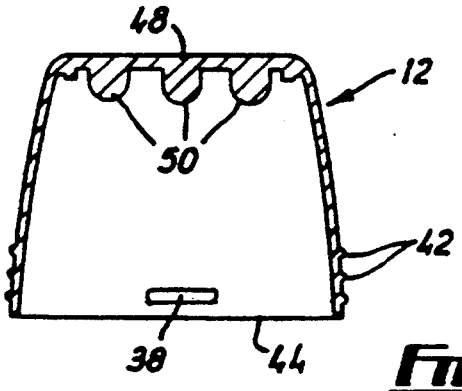
FIG. 5 shows a cross-sectional view of the cap.
Figure 6:
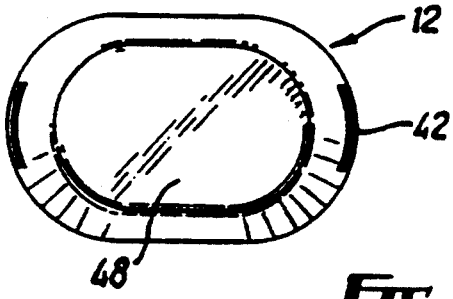
FIG. 6 shows a plan view of the cap.

Referring now to FIGS. 5 and 6, the cap 12 has internal protrusions 38 which are positioned to clip over corresponding protrusions 40 provided on the exterior of the bottle 10 when the cap is placed over the neck region 16 of the bottle. The exterior of the cap is provided with parallel ribs 42 towards the open mouth 44 thereof. When the cap is clipped to the bottle, a user can grip the cap at the ribs 42 and apply a squeezing action to deform the cap slightly so that the protrusions 38 disengage from the protrusions 40 and permit the cap to be separated from the bottle.

In other embodiments, mould costs may be reduced by omitting the ribs 42.

The upper end of the bottle is formed with three outlets 52, one for each of the compartments. Each outlet communicates with a circular, continuous rim 56 which projects upwardly for a short distance. The rims 56 are spaced from and totally independent of one another. The one-piece spout member 11 provides three directional pouring spouts 70 and is fitted frictionally to the rims 56 in the manner seen in FIG. 8. One pouring spout 70 communicates with each of the outlets 52. It will be noted that each pouring spout 70 is defined by its own separate circumscribing wall and that these walls are not shared by the other pouring spouts and are spaced apart from one another.

The term "directional pouring spout" refers to a spout shaped to encourage the formation of a narrow, well-defined stream of liquid when the liquid is poured through the spout. As illustrated, the directional pouring spouts 70 have convergent lips 72, similar to those of a milk jug or the like, for the formation of well-defined streams of poured liquid as illustrated by FIG. 7. Thus the contents of the three compartments do not mix with one another as they leave the spouts and descend under gravity in separate streams.

In practice, in the case of components which are to be mixed to form a liquid mouthwash, the three streams are poured into the cap 12 or a cup in which they mix and from which the user can take a mouthful of the resulting mixture for mouthwashing purposes.

Figure 8:
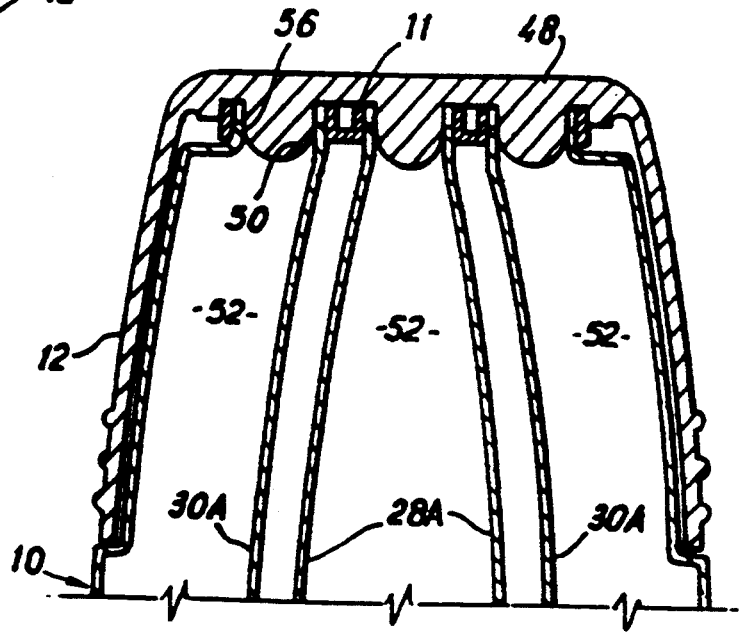
FIG. 8 illustrates the manner in which the cap seals the bottle of the first embodiment.

The base portion 48 of the cap carries three rounded sealing formations 50 which are spaced apart to fit the three pouring spouts 70. When the cap is clipped to the bottle as described above, the sealing formations enter and plug the three pouring spouts as illustrated in FIG. 8.

Referring again to FIG. 7, it wil be appreciated that the generally elliptical nature of the bottle is such as to promote gripping by a user in such a manner that, during subsequent tilting to pour out the contents of the bottle, an imaginary straight line 60 passing through the centres of the pouring spouts 52 remains horizontal. Of course, this feature contributes to equal rate pouring from all three compartments and renders it unlikely that any one compartment will be exhausted substantially before its neighbours.

It will also be appreciated that the visible, directional nature of the pouring spouts 70 will encourage correct manipulation by the user. A further advantage provided by the separate spouts 70 is the fact that there is little danger of cross-contamination of the three liquid components when the bottle is righted again after a dispensing operation. Because the circumscribing walls of the spouts 70 are entirely separate and spaced apart, drops of liquid at the edges of the spouts after pouring will be obliged to return to their own compartments rather than running back into the wrong compartment when the bottle is righted.

This feature is most important in the case of an effervescent mouthwash, since one of the liquid components will be chosen to produce the desired effervescence and it would clearly be undesirable to have effervescence taking place in one or other of the compartments before final mixing in the cap 12 or cup takes place.

This version of the invention is not limited in any way to the precise configuration described above. For instance, instead of a separate spout member 11 as described above, the pouring spouts, directional if desired, could be moulded integrally with the bottle 10. In fact, even if the spout member 11 were to be omitted entirely, it is anticipated that the presence of the circular rims 56 alone could prevent undesired cross-contamination of the contents of the three compartments if the bottle is tilted and righted in the correct manner.

Reference is now made to FIGS. 1 to 9 of the drawings which illustrate second embodiment of the invention. This embodiment has a bottle 100. Fitted over the neck region 102 of the bottle 100 is a moulded plastics member 104 having a side skirt 106 which engages the lower end of the neck region in a snug fit. The skirt 106 is formed with an elliptical depression 108 on one side thereof as illustrated. Three directional pouring spouts 110 are provided at the upper end of the elliptical depression. The pouring spouts 110 are defined by a continuous wall 112 which extends from a base 114.

Moulded integrally with the member 104 is a cap 116 which is joined to the junction of the skirt 106 and the base 114 at a live hinge 118. The cap 116 has a base wall 120 and a depending side skirt 122. The live hinge 118 is of a known type which permits the cap 116 to be pivoted in the direction indicated by the arrow 124 to an open position, and which then maintains the cap in that open position until such time as it is forced gently in the opposite direction to return it to the illustrated, closed position. Thus the cap 116 acts as a captive, flip-top cap. Clip formations can if desired be incorporated on the cap and member 104 to ensure that the cap clips home when closed.

Figure 9:
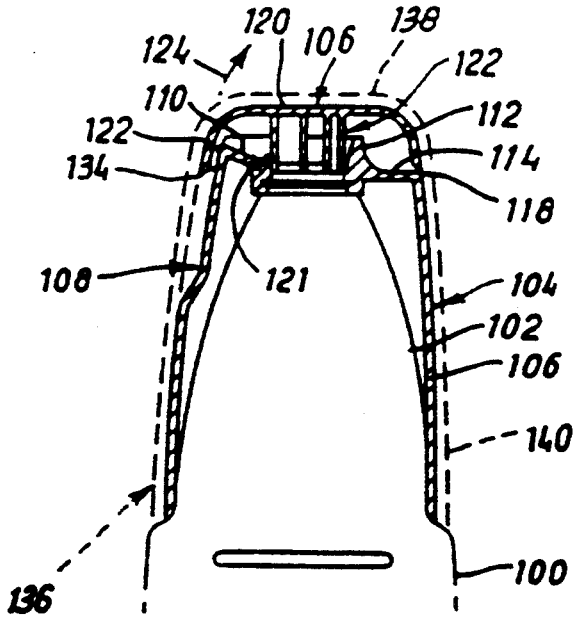
FIG. 9 shows a cross-sectional view of the upper part of a second embodiment of the invention.
Figure 10:
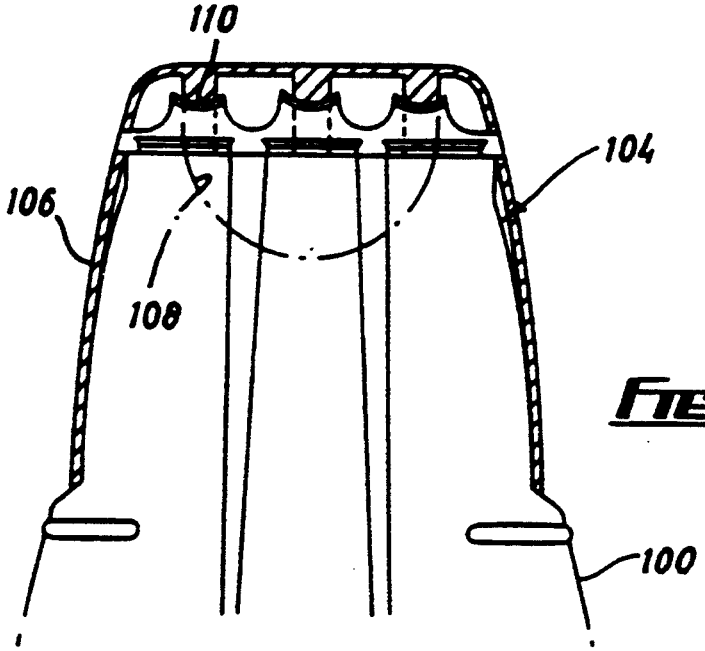
FIG. 10 shows a further cross-sectional view of the upper part of the second embodiment and FIG. 11 shows a plan view of the upper part of the second embodiment with the flip-top cap removed.
Figure 11:
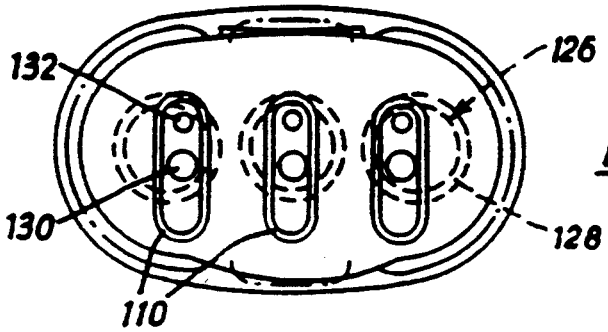

Depending from the underside of the base wall 120 of the cap 116 is a series of six tubular sealing formations 121, only two of which are visible in the view of FIG. 9.

The base 114 of the member 104 obturates the outlets 126 of the bottle, the outlets 126 are similar to the outlets 52 of the first embodiment. In other words, the base 114 bears upon the upper edges of the rims 128 which are provided at the outlets 126. Within the area circumscribed by each circular rim 128, two circular apertures 130, 132 are formed through the base 114. The aperatures 130 are somewhat greater in diameter than the apertures 132. In practice, the apertures 130 will serve as pouring apertures while the apertures 132 will serve as air passages to avoid "glugging" when the bottle is tilted to dispense its contents. It will be seen that the apertures 130, 132 lead into the directional pouring spouts 110.

The tubular sealing formations 121 are dimensioned to fit into and to plug the apertures 130 and 132 when the cap 116 is in the FIG. 9, closed position. It will therefore be appreciated that the flip-top cap 116 is captive and flip-top in nature.

The elliptical depression 108 in the member 104 facilitates opening of the cap 116. In use, the user grasps the bottle 10 and applies his thumbnail, or the end of his thumb, to the edge 134 of the cap 116. He presses upwardly on this edge to pivot the cap, about the live hinge 118, to the open position, whereafter pouring can take place in the same manner as is illustrated in FIG. 7.

As thus far described, the embodiment of the invention has no provision for a cap into which the contents of the bottle 10 can be poured for mixing. It is accordingly also proposed to provide a separate cap 136, illustrated in broken outline in FIG. 9, which has a base 138 and a side skirt 140 dimensioned to fit frictionally about the side skirt 106 of the member 104. When a dispensing and mixing operation is to take place, the user merely pulls the cap 136 off the member 104 prior to flipping the flip-top cap 116 to the open position in the manner described above.

The principles of the invention extend to dispensing containers of multi-compartment type having two or more than three compartments.

We claim:

1. A dispensing container which includes:

a) a moulded bottle formed in one piece and comprising at least two distinct compartments for accommodating different fluent materials, each compartment having an outlet at an operatively upper end thereof, the compartments having equal total volumes and also having equal cross-sectional areas at each level of the bottle, the bottle having a cross-section which tapers in a direction from a bottom portion to a top portion thereof;

b) a pouring spout communicating with each of the compartment outlets, the pouring spouts being spaced apart from one another with the centres of the pouring spouts lying on an imaginary straight line, each pouring spout being defined by a continuous circumscribing wall which is spaced apart by the circumscribing wall of any other pouring spout not shared by any other pouring spout;

c) a single cap dimensioned to fit onto the operatively upper end of the bottle and having sealing means for sealing all the pouring spouts simultaneously when so fitted; the design of the spout and bottle being such that when the cap is removed and the bottle is tilted away from an upright orientation with the imaginary straight line remaining horizontal, the contents of the compartments are dispensed simultaneously at equal flow rates and in distinct streams, from the compartments without cross contamination between adjacent streams, and when the bottle is thereafter returned to an upright orientation, fluent material originating from one compartment is prevented from flowing back into any other compartment and cross-contamination of the compartments is avoided, and d) an air vent associated with each compartment which is also sealed by the cap when the cap is fitted onto the operatively upper end of the bottle; the provision of an air vent for each compartment outlet allowing air to enter each compartment as the contents of the compartments are dispensed, thereby ensuring that the contents of the compartments are dispensed smoothly in their distinct streams, the cap and bottle having cooperating clip formations which engage one another in clipping fashion when the cap is correctly fitted onto the upper end of the bottle.

2. A dispensing container according to claim 1 wherein the pouring spouts are directional pouring spouts.

3. A dispensing container according to claim 1 or claim 2 wherein the pouring spouts are provided by a one-piece spout member fitted to the outlets of the compartments.

4. A dispensing container according to claim 1 or claim 2 wherein the pouring spouts are provided by a member fitted to the operatively upper end of the bottle, and wherein the cap is is a flip-top cap formed in one piece with the member and joined to the member at a live hinge.

5. A dispensing container according to claim 1 or claim 2 wherein the cap carries internally projecting formations which plug the pouring spouts when the cap is correctly fitted to the bottle.

6. A dispensing container according to claim 1 or claim 2 wherein the bottle has an external shape that is chosen to facilitate manual gripping by a user in such manner that tilting of the bottle by the user to dispense therefrom will generally be such as to maintain the imaginary straight line horizontal.

7. A dispensing container according to claim 1 or claim 2 wherein the compartments accommodate components of a liquid mouthwash.

8. A dispensing container according to claim 1, wherein the bottle has three compartments each for accommodating a different fluent material.

9. A dispensing container according to claim 8 wherein the bottle has a central compartment and two outer compartments symmetrically arranged on opposite sides of the central compartment, the central compartment having a generally rectangular cross-sectional shape over at least a part of the height of the bottle and the two outer compartments each having a generally semi-circular cross-sectional shape over the same part of the height of the bottle.

10. A dispensing container according to claim 1 wherein each compartment is defined by its own continuous wall which is not shared by the wall defining any other compartment, the walls of adjacent compartments being connected integrally to one another by means of joining portions.

11. A dispensing container according to claim 10 wherein the joining portions of the walls of adjacent compartments space those walls apart from one another to create externally visible grooves extending for the height of the bottle.

12. A dispensing container according to claim 1 wherein the bottle is of blow-moulded construction.

13. A dispensing container according to claim 1 wherein the bottle has a continuous external shoulder towards its upper end against which the cap bears when clipped to the bottle.

14. A dispensing container according to claim 1 wherein the clipping formations of the cap and the bottle are disengagable from one another to permit removal of the cap from the bottle when an appropriate squeezing action is applied to the cap in a direction transverse to the height of the bottle.

* * * * *